United States Patent [19]

Becka

[11] 4,227,483

[45] Oct. 14, 1980

[54] ADHESIVE APPLYING MACHINE

[75] Inventor: Michael M. Becka, Nashua, N.H.

[73] Assignee: International Shoe Machine Corporation, Nashua, N.H.

[21] Appl. No.: 955,032

[22] Filed: Oct. 26, 1978

[51] Int. Cl.[3] ..... A43D 25/18; A43D 25/047; B05C 5/02

[52] U.S. Cl. ..... 118/411

[58] Field of Search ..... 118/410, 411, 412

[56] References Cited

U.S. PATENT DOCUMENTS

| | | | |
|---|---|---|---|
| Re. 29,069 | 12/1976 | Lindsey | 12/14.5 |
| 3,251,081 | 5/1966 | Springer | 118/410 X |

FOREIGN PATENT DOCUMENTS

| | | | |
|---|---|---|---|
| 2424324 | 4/1975 | Fed. Rep. of Germany | 118/411 |

*Primary Examiner*—John P. McIntosh
*Attorney, Agent, or Firm*—Albert Gordon

[57] ABSTRACT

A machine for applying adhesive to the toe portion of an insole mounted to the bottom of a last through the top of an applicator. The insole is located on an inclined plane and the applicator lies in the inclined plane and bears flushly against the insole when the applicator is applying the adhesive to the insole. The applicator is mounted for such movement that the applicator top lies in a horizontal plane when the applicator is not moving towards and away from the insole and is not bearing against the insole.

2 Claims, 4 Drawing Figures

ADHESIVE APPLYING MACHINE

BACKGROUND OF THE INVENTION

The machine disclosed in U.S. Pat. Re. 29,069 is typical of prior machines for applying adhesive to a portion of the bottom of a workpiece wherein the workpiece bottom portion is so supported that it lies in a prescribed plane that is inclined from the horizontal. Such a machine has an applicator assembly located below the workpiece portion that is connected to an applicator mount. The applicator mount is mounted for heightwise movement between a lower position wherein the applicator assembly top is spaced from the workpiece portion and an upper position wherein the applicator assembly top lies in the aforementioned prescribed plane and bears against the workpiece portion. Adhesive feeding means are incorporated in the machine that are actuable to expel adhesive from the applicator assembly top onto the workpiece portion. The machine has means for initially retaining the applicator mount in its lower position; means for thereafter raising the applicator mount to its upper position; means for actuating the adhesive feeding means while the applicator mount is in its upper position; and means for thereafter lowering the applicator mount to its lower position.

Because, in the prior art machine, the top of the applicator assembly is at all times in a plane that is inclined from the horizontal, there is a tendency for the adhesive in the applicator assembly to flow from the top of the applicator assembly onto other parts of the machine and foul these other machine parts. In addition, this flowing of the adhesive away from the top of the applicator assembly tends to deplete the adhesive in the applicator assembly and thus reduce the efficiency of the adhesive feeding means in expelling an adequate quantity of adhesive onto the workpiece.

SUMMARY OF THE INVENTION

In order to overcome the deficiencies described in the preceding paragraph, the prior machine has been improved by so connecting the applicator assembly to the applicator mount as to enable movement of of the applicator assembly relative to the applicator mount between an idle position wherein the applicator assembly top lies in a substantially horizontal plane and a working position wherein the applicator assembly top lies in a plane parallel to the aforementioned prescribed plane. The improved machine further comprises means for initially retaining the applicator assembly in its idle position, means effective by the completion of the rise of the applicator mount from its lower position to its upper position to move the applicator assembly to its working position, and means effective subsequent to the actuation of the adhesive feeding means to move the applicator assembly from its working position back to its idle position.

DESCRIPTION OF THE PREFERRED EMBODIMENT

Figure 1:
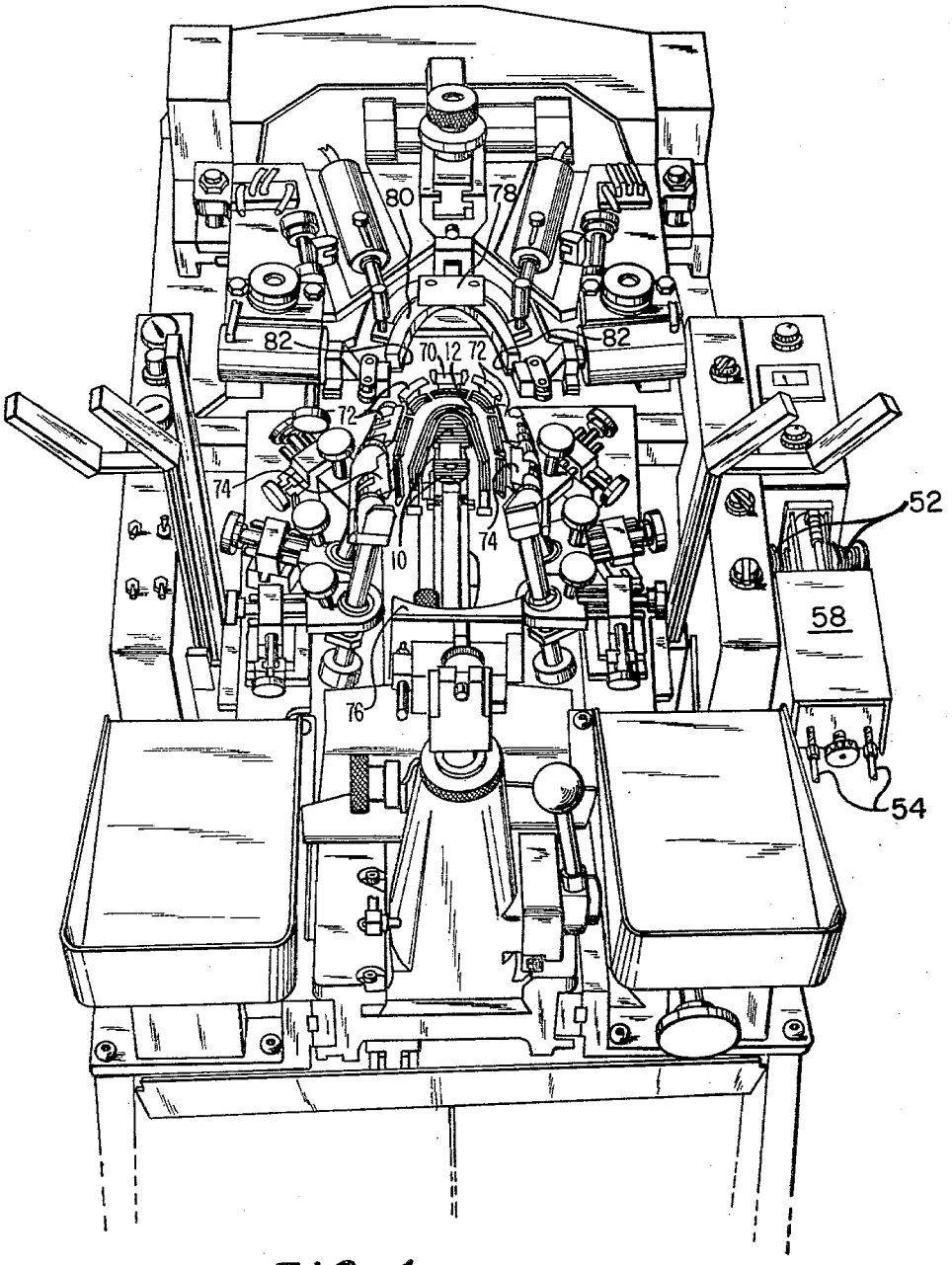
FIG. 1 is a front view of the machine.

The operator is intended to face the machine as seen in FIG. 1. The part of the machine closest to the operator is considered to be the front of the machine and the part of the machine furthermost from the operator is considered to be the back of the machine. Parts moving towards the operator are considered to have "forward" movement and parts moving away from the operator are considered to have "rearward" movement.

Figure 2:
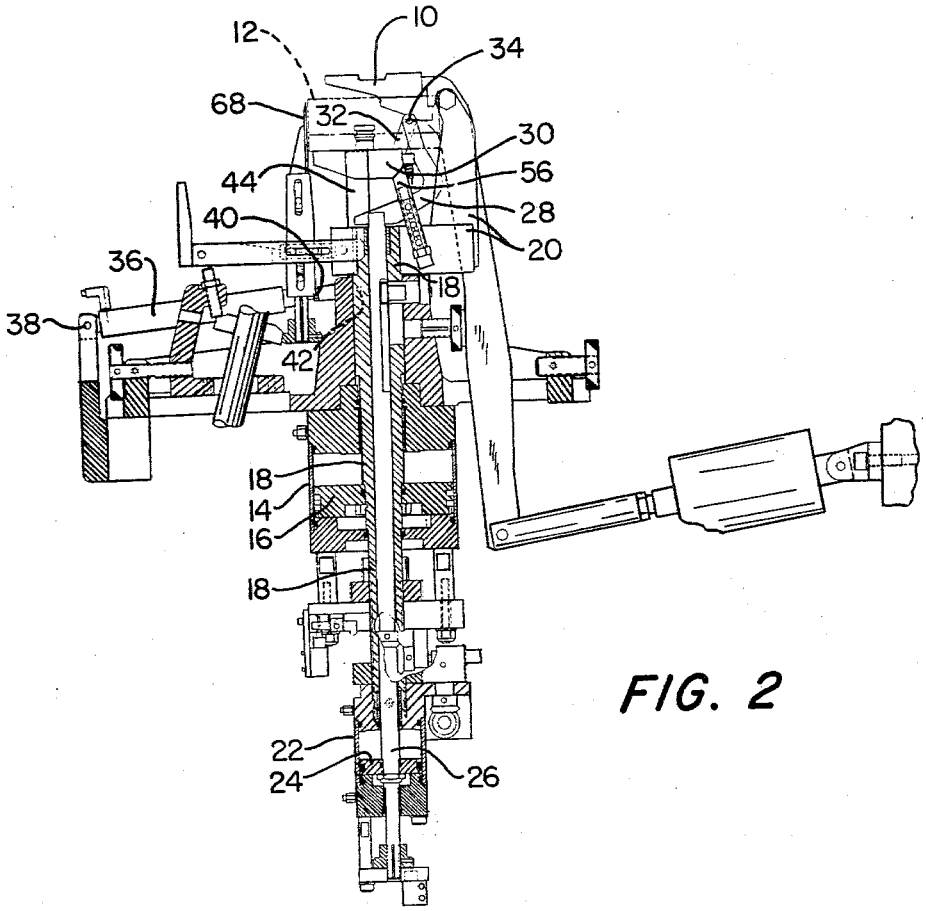
FIG. 2 is a verticle section of a portion of the machine showing mechanism for moving the applicator assembly heightwise.

Referring to FIGS. 1 and 2, the machine includes a toe rest 10 and an adhesive applicator 12. The top of the toe rest 10 and the top 13 of the applicator 12 when the applicator is in its operative position as shown in FIG. 2 lie in parallel planes that are inclined forwardly and downwardly for ease of presentation of a shoe assembly to the machine. The heightwise movements of the toe rest 10 and the applicator 12 and the heightwise movements of the members causing heightwise movements of the toe rest 10 and the applicator 12, as described below, are movements inclined from the vertical at right angles to the above referred to inclined planes.

Referring to FIG. 2, the machine includes a fixedly mounted pneumatic motor 14 operative to move its piston 16 heightwise. A sleeve 18 is secured to the piston 16 for heightwise movement in unison with the piston 16. A bracket 20 is secured to the top of the sleeve 18 and the toe rest 10 is mounted to the top of the bracket 20.

Figure 3:
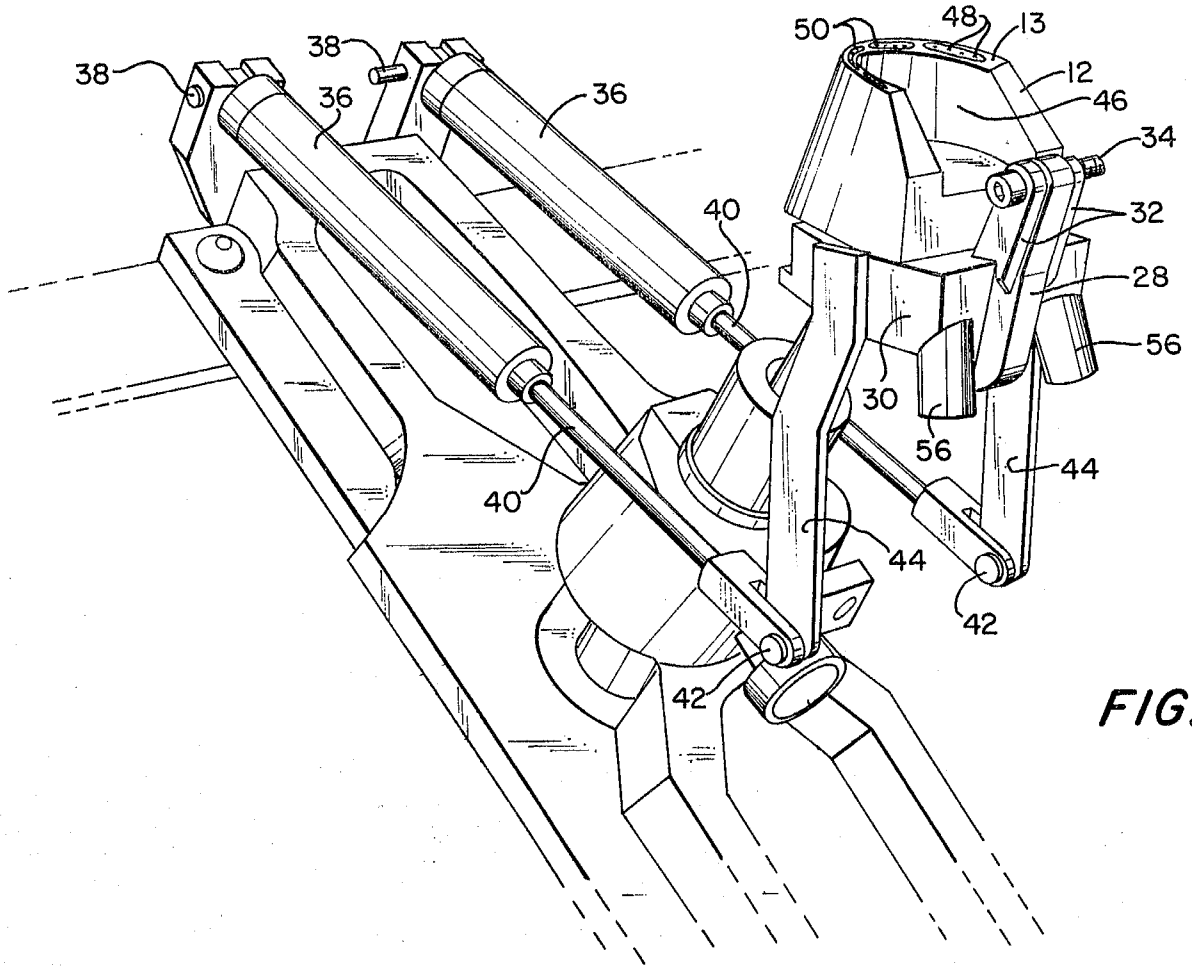
FIG. 3 is an isometric view of the mechanism for moving the applicator assembly between its idle and working positions.

The bottom of the sleeve 18 is secured to a pneumatic motor 22 operative to move its piston 24 heightwise. The piston 24 is secured to a rod 26 that is slidably mounted in the sleeve 18. Referring to FIGS. 2 and 3, a bracket 28 is secured to and extends upwardly of the top of the rod 26. A housing 30 has upwardly extending fingers 32 that straddle the bracket 28 and are pivoted to the bracket for swinging movement by a pivot pin 34. A pair of pneumatic motors 36 are pivoted to the machine frame by pivot pins 38. The piston rod 40 of each motor 36 is pivoted by a pivot pin 42 to the bottom of an arm 44 and the top of the arm 44 is secured to the housing 30. The applicator 12 is mounted to the top of the housing 30.

The applicator 12 is constructed similarly to the applicator 120 of U.S. Pat. No. Re. 26,738. The top of the applicator 12 is roughly U-shaped to correspond to the shape of the periphery of the toe portion of a shoe insole to which it applies adhesive. A recess 46 in the applicator 12 accommodates the toe rest 10 so that the applicator can be located outwardly of the toe rest. Adhesive is extrudable from the applicator top through a plurality of holes 48 in the applicator top that intersect grooves 50 in the applicator top. In a manner similar to that shown in U.S. Pat. Nos. 3,422,797 and 3,575,137, flexible rods of thermoplastic adhesive are directed from supply reels 52 (FIG. 1) through flexible tubes 54 and bosses 56, FIGS. 2 and 3, of the housing 30, the adhesive rods being melted in the housing 30 and then forced through the holes 48 pursuant to feeding of the rods by a feeding mechanism 58 (FIG. 1) which is similar to the feeding mechanism 152 shown in U.S. Pat. No. 3,304,563.

In the idle condition of the machine: the piston 16 is in a lowered position in the motor 14 to maintain the insole rest 10 and the applicator 12 in lowered positions; the piston rod 24 is in a lowered position in the motor 22 to maintain the applicator 12 lower than the insole rest 10; the piston rods 40 are retracted into the motors 36 to thereby enable the applicator 12 and the housing 30 to be so swung about the axis of the pivot pin 34 that the top of the applicator 12 lies in a substantially horizontal plane; and the feeding mechanism 48 has fed the adhesive rods into the housing 30 to such an extend as to cause molten adhesive in the applicator 12 to be just below the grooves 50 in readiness to be forced through the holes 48 into the grooves 50.

Figure 4:
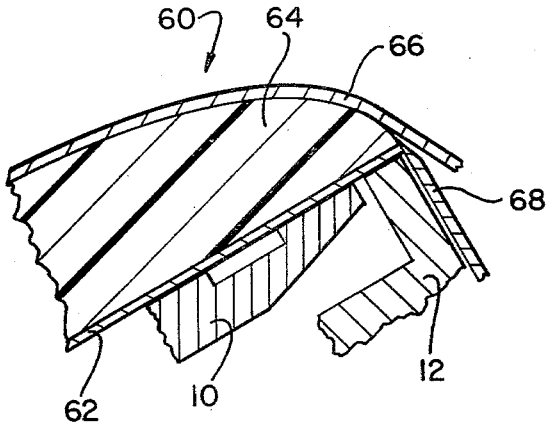
FIG. 4 is a view of the workpiece as it appears in the machine when the applicator assembly is bearing against it.

Referring to FIG. 4, a shoe assembly 60 is presented bottomdown to the machine. The shoe assembly 60 comprises a shoe insole 62 located on the bottom of a last 64 and a shoe upper 66 draped over the last. The operator places the shoe assembly on the toe rest 10 with the toe and extremity of the last 64 bearing against a toe bar 68 (FIG. 2). Referring to FIG. 1, the operator then, in the manner shown in U.S. Pat. applications Nos. 932,581 and 932,596 filed Aug. 10, 1978, causes toe pincers 70, side pincers 72 and ball pincers 74 to grip the margin of the upper 66 after which the motor 14 is actuated to raise the piston 16 to thereby raise the toe rest 10 while the upper margin is being gripped by the pincers 70, 72, and 74 to thereby stretch the toe portion of the upper 66 about the corresponding portion of the last, the applicator 12 rising in unison with the toe rest 10. After this, a heel clamp 76 (FIG. 1) is brought to bear against the heel end of the shoe assembly 60.

Except for the tilting of the applicator 12 by the motors 36, as described below, the remainder of the machine cycle is substantially the same as described in U.S. Pat. No. Re. 29,069 and British Pat. No. 1,341,967. A toe hold-down 78 (FIG. 1) is brought to bear against the top of the vamp of the shoe assembly 60. A slide plate (not shown) which carries a toe pad 80 and toe wipers 82 is caused to move forwardly to a position wherein the toe pad clamps the toe portion of the upper 66 against the last 64 and the wipers 82 are placed in a position of readiness for wiping. During the forward movement of the slide plate the toe bar 68 is caused to be moved downwardly to prevent the toe bar from interfering with the wipers 82 during the below described wiping stroke.

After this, the motor 22 is actuated to raise its piston rod 24 to thereby move the applicator 12 towards the bottom of the toe portion of the insole 62. Before the applicator 12 engages the insole bottom, the motors 36 are actuated to project their piston rods 40 so as to swing the applicator 12 and the housing 30 about the axis of the pin 34 an amount such that the top of the applicator 12 moves from its substantially horizontal plane to the aforementioned inclined plane that is parallel to the plane of the top of the toe rest 10 and is also substantially parallel to the plane of the bottom of the toe portion of the insole 62. The engagement of the applicator 12 with the toe portion of the bottom of the insole 62 terminates the upward movement of the piston rod 24 and the applicator 12 when so engaged with the insole bottom is, due to the actuation of the motors 36, bearing flushly against the toe portion of the insole bottom with the top of the applicator substantially coplanar with the bottom of the toe portion of the insole, as shown in FIG. 4. Now the feeding mechanism 58 is operated to force a quantity of molten thermoplastic adhesive through the holes 48 and into the grooves 50 wherein the adhesive adheres to the periphery of the bottom of the toe portion of the insole 62. This is followed by an actuation of the motor 22 to lower the piston 24 to thereby lower the applicator 12 and an actuation of the motors 36 to retract their piston rods 38 to their idle positions to thereby swing the top of the applicator 12 back into its horizontal plane. The motors 36 are so actuated after the operation of the feeding mechanism 58 and preferably after the top of the applicator 12 has been lowered out of engagement with the insole 62.

Now the toe wipers 82 are caused to move forwardly and inwardly with respect to the now stationary slide plate in a wiping stroke to enable the toe wipers to wipe the toe portion of the margin of the upper 66 against the insole 62 and bond the upper margin to the insole by means of the adhesive that had been applied to the insole by the applicator 12. Prior to the completion of the wiping stroke, the pincers 70, 72 and 74 are caused to release the upper margin and the motor 14 is actuated to lower the piston rod 16 to thereby lower the toe rest 10 out of the path of the wipers 82.

When the top 13 of the applicator 12 is in its inclined plane, there is a tendency for the molten thermoplastic adhesive in the applicator to flow from the top of the applicator onto other parts of the machine and solidify, thus fouling these other machine parts. In addition, this flowing of the adhesive away from the top of the applicator tends to deplete the adhesive at the tops of the holes 48 to thus reduce the efficiency of the feeding mechanism 58 in expelling an adequate quantity of adhesive into the grooves 50 to adhere to the insole 52. By having the top 13 of the applicator 12 in its inclined plane only when it is being raised against the insole 62, is bearing against the insole, and is being lowered away from the insole and by having the top of the applicator in a horizontal plane at all other times, the disadvantageous effects resulting from the top 13 of the applicator 12 being in its inclined plane are minimized.

There follows a recapitulation of the description of the machine and its mode of operation insofar as they are germane to this invention.

The machine, as known in the prior art, comprises an adhesive applying mechanism that includes a support formed by the toe rest 10, having a top surface lying in a prescribed plane that is inclined from the horizontal, that so supports a workpiece formed by the shoe assembly 60 that the bottom of a portion of the workpiece (the toe portion of the insole 62) substantially lies in said prescribed plane. The applicator 12 and the housing 30 form an applicator assembly located below the workpiece portion. The rod 26 and the bracket 28 form an applicator mount that is connected to the applicator assembly 12,30 and that is mounted for heightwise movement between a lower position wherein the top 13 of the applicator assembly 12,30 is spaced from the workpiece portion and an upper position wherein the applicator assembly top 13 lies in said prescribed plane and bears against the workpiece portion. The feeding mechanism 58 forms adhesive feeding means actuable to expel adhesive from the applicator assembly top 13 onto the workpiece portion. The motor 22 forms means for initially retaining the applicator mount 26,28 in its lower position and also forms means for thereafter raising the applicator mount 26,28 to its upper position. Means similar to that shown in U.S. Pat. No. 3,304,563 actuates the adhesive feeding means 58 while the applicator mount 26,28 is in its upper position. The motor 22 forms means for thereafter lowering the applicator mount 26,28 to its lower position.

The machine described in the preceding paragraph is improved, in accordance with this invention, as follows. The applicator mount 26,28 and the applicator assembly 12,30 are so connected to each other by the pivot pin 34 as to enable movement of the applicator assembly 12,30 relative to the applicator mount 26,28 between an idle position wherein the applicator assembly top 13 lies in a substantially horizontal plane and a working position wherein the applicator assembly top 13 lies in a plane parallel to the aforementioned prescribed plane. The motors 36 form actuable powered means connected to the applicator assembly 12,30 for moving the applicator assembly between its idle and working positions. A portion of the machine control (not shown) acts as means for so initially actuating the powered means 36 as to initially retain the applicator assembly 12,30 in its idle position. A portion of the machine control (not shown) acts as means effective by the completion of the rise of the applicator mount 26,28 from its lower position to its upper position to so actuate the powered means 36 as to cause the powered means 36 to move the applicator assembly 12,30 to its working position. A portion of the machine control (not shown) acts as means effective subsequent to the actuation of the adhesive feeding means 58 to so actuate the powered means 36 as to cause the powered means 36 to move the applicator assembly 12,30 from its working position to its idle position.

The connection between the applicator mount 26,28 and the applicator assembly 12,30 is a pivotal connection formed by the pivot pin 34 and the powered means 36 is so connected to the applicator assembly 12,30 as to effect swinging movement of the applicator assembly 12,30 about the axis of the pivotal connection 34.

I claim:

1. An adhesive applying machine comprising: a support having a top surface lying in a prescribed plane that is inclined from the horizontal for so supporting a workpiece that the bottom of at least a portion of the workpiece substantially lies in said prescribed plane; an applicator assembly located below said workpiece portion; connecting means connecting the applicator assembly to an applicator mount; means mounting the applicator mount for heightwise movement between a lower position wherein the applicator assembly top is spaced from said workpiece portion and an upper position wherein the applicator assembly top lies in said prescribed plane and bears against said workpiece portion; adhesive feeding means actuable to expel adhesive from the applicator assembly top onto said workpiece portion; means for initially retaining the applicator mount in said lower position; means for thereafter raising the applicator mount to said upper position; means for actuating the adhesive feeding means while the applicator mount is in said upper position; and means for thereafter lowering the applicator mount to said lower position; characterized in that said connecting means so connects the applicator assembly to the applicator mount as to enable movement of the applicator assembly relative to the applicator mount between an idle position wherein the applicator assembly top lies in a substantially horizontal plane and a working position wherein the applicator assembly top lies in a plane parallel to said prescribed plane; and characterized in that the machine comprises: actuable powered means connected to the applicator assembly for moving the applicator assembly between said idle and working positions; means for so initially actuating the powered means as to initially retain the applicator assembly in said idle position; means effective by the completion of the rise of the applicator mount from said lower position to said upper position to so actuate the powered means as to cause the powered means to move the applicator assembly to said working position; and means effective subsequent to the actuation of the adhesive feeding means to so actuate the powered means as to cause the powered means to move the applicator assembly from said working position back to said idle position.

2. The machine of claim 1 characterized in that said connecting means comprises a pivotal connection between said mount and said applicator assembly; and characterized in that the powered means is so connected to the applicator assembly as to effect swinging movement of the applicator assembly about the axis of said pivotal connection.

* * * * *

UNITED STATES PATENT AND TRADEMARK OFFICE

CERTIFICATE OF CORRECTION

PATENT NO. : 4227483

DATED : October 14, 1980

INVENTOR(S) : Michael M. Becka

It is certified that error appears in the above-identified patent and that said Letters Patent are hereby corrected as shown below:

Column 3, lines 2, 47 and 60 and column 4, line 20: delete "rod".

Column 3, line 8: change "48" to --58--.

Column 4, line 4: change "38" to --40--.

Signed and Sealed this

*Twentieth* Day of *January 1981*

[SEAL]

*Attest:*

RENE D. TEGTMEYER

*Attesting Officer*

*Acting Commissioner of Patents and Trademarks*